US005420826A

United States Patent [19]

Abramovitz

[11] Patent Number: 5,420,826

[45] Date of Patent: May 30, 1995

[54] OPTICAL CORRELATOR AND METHOD OF USING SAME

[75] Inventor: Irwin J. Abramovitz, Baltimore, Md.

[73] Assignee: Westinghouse Electric Corp., Pittsburgh, Pa.

[21] Appl. No.: 137,328

[22] Filed: Oct. 18, 1993

[51] Int. Cl.[6] ..... G06G 7/195

[52] U.S. Cl. ..... 367/100; 359/306

[58] Field of Search ..... 367/100; 364/822; 342/189; 359/306; 250/216

[56] References Cited

U.S. PATENT DOCUMENTS

| | | | |
|---|---|---|---|
| 5,121,248 | 6/1992 | Mohon et al. | 364/822 |
| 5,327,105 | 7/1994 | Liberman et al. . | |
| 5,327,111 | 7/1994 | Gipprich . | |
| 5,327,130 | 7/1994 | Kang et al. . | |
| 5,331,276 | 7/1994 | Polvani et al. . | |
| 5,334,959 | 8/1994 | Krafcsik et al. . | |
| 5,334,980 | 8/1994 | Decker . | |
| 5,335,209 | 8/1994 | Jaenke et al. | 367/155 |
| 5,336,631 | 8/1994 | Potyraj et al. . | |
| 5,337,185 | 8/1994 | Meier et al. . | |
| 5,337,411 | 8/1994 | Harrison, Jr. . | |
| 5,339,038 | 8/1994 | Boenning et al. . | |
| 5,339,283 | 8/1994 | Gilmour | 367/89 |
| 5,340,015 | 8/1994 | Hira et al. . | |
| 5,341,136 | 8/1994 | Przybysz et al. . | |

*Primary Examiner*—Daniel T. Pihulic

*Attorney, Agent, or Firm*—Christopher O. Edwards

[57] ABSTRACT

An apparatus including a first light modulator for modulating a first light beam with a signal, a second light modulator for modulating a second light beam with a reference signal, first lens means, positioned in an optical path of the second light beam, for introducing into the second light beam horizontal magnification/demagnification which gradually varies with respect to a vertical direction, a beam combiner for combining the first and second light beams, and photodetecting means for detecting the combined light beam received from the beam combiner. The apparatus, thus constructed, is capable of processing the 50 to 100 billion operations per second required for true Doppler (time compression/expansion) processing of SONAR signals.

27 Claims, 14 Drawing Sheets

FIG. 1
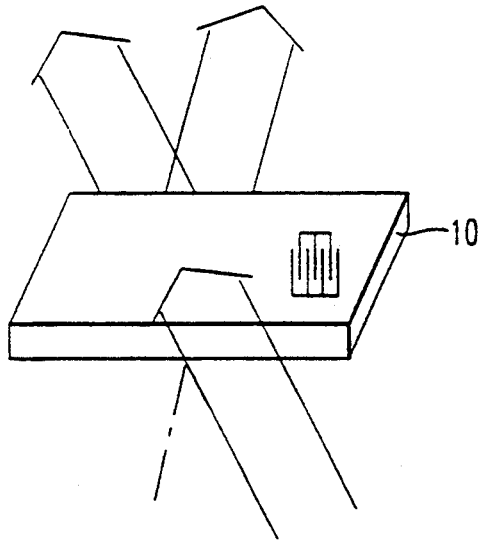
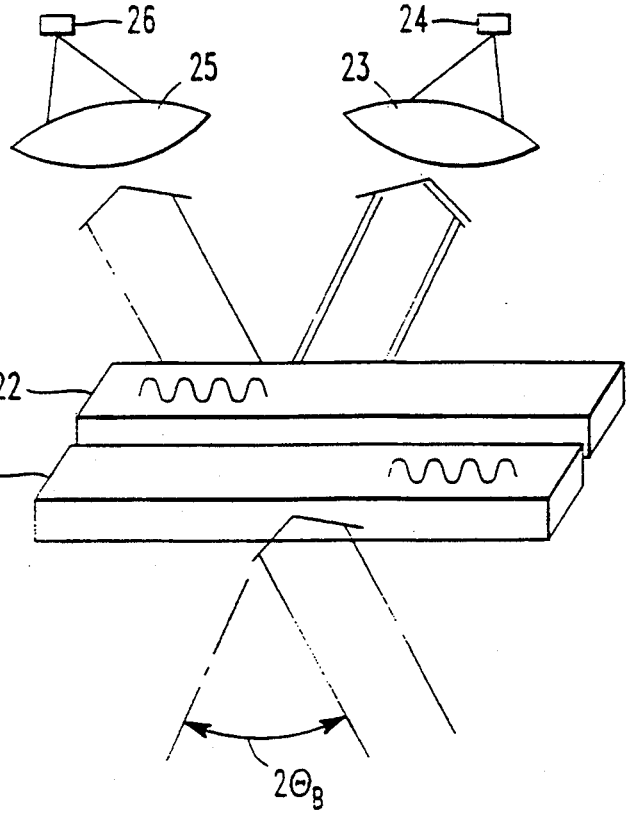
FIG. 2

FIG. 6A
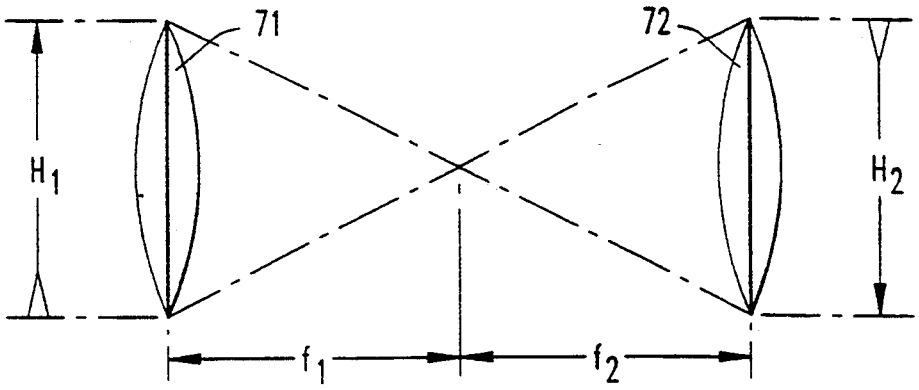
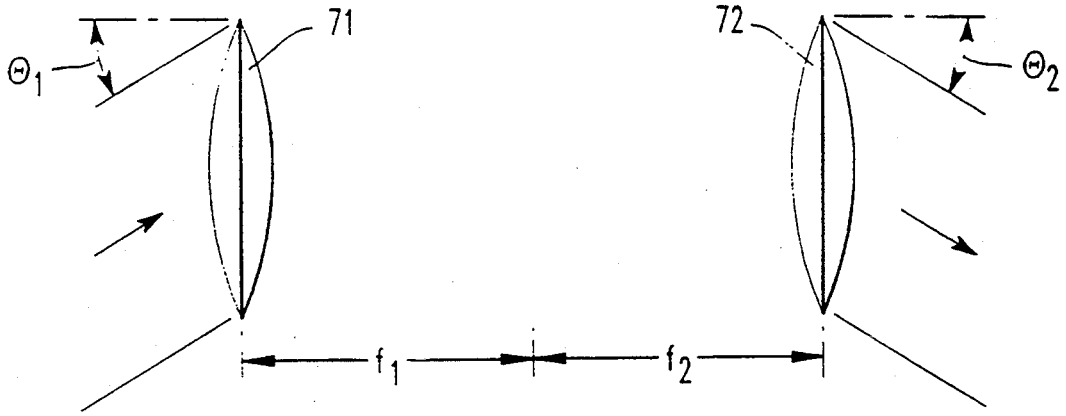
FIG. 6B

FIG. 9A
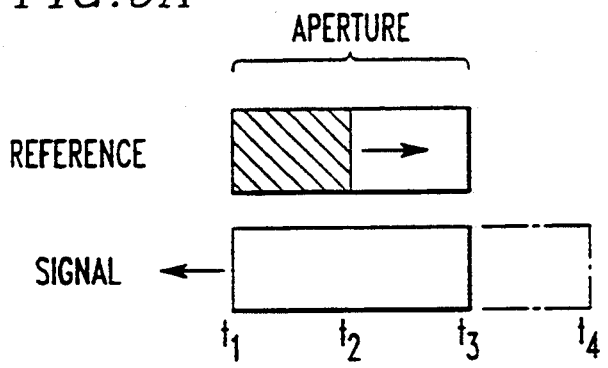
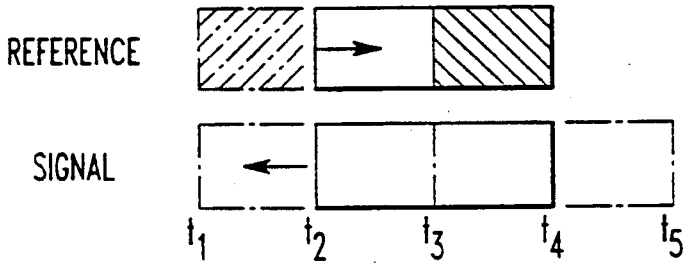
FIG. 9B
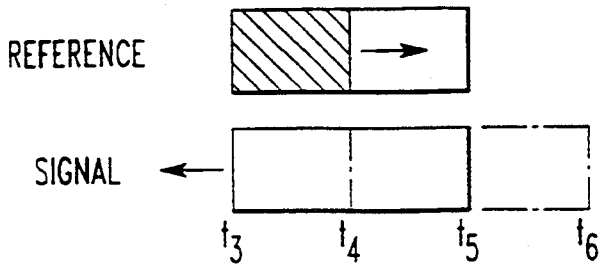
FIG. 9C

OPTICAL CORRELATOR AND METHOD OF USING SAME

BACKGROUND OF THE INVENTION

1. Field of the Invention

The present invention relates to an optical correlator and a method for optically correlating. More particularly, the present invention relates to an acousto-optic correlator useful in correlating Doppler sensitive SONAR.

2. Discussion of the Related Art

Undersea reconnaissance is changing along with changes in shipbuilding and propulsion technologies. Active SONAR is taking on new roles, and new signal formats are being investigated. Advances in signal processing have enabled system designers to look beyond Doppler insensitive waveforms in order to take advantage of the additional target discrimination offered by Doppler processing. However, Doppler processing requirements greatly increase the computational load of a SONAR system. Particularly on platforms for which size, weight, and power are critical factors, alternatives to digital signal processing are needed.

Recent technology advances have resulted in a reduction of the sound generated by undersea vehicles. Thus, active techniques for undersea surveillance have taken on new importance. Due to the varied and often turbulent nature of the sea, effective undersea surveillance has become a complex process involving directional projectors, hydrophone arrays, and sophisticated signal processing in order to detect target echoes in the presence of ambient noise and reverberation. One technique to provide echo enhancement over reverberation, which is caused by the reradiation of sound by the sea, is the use of widebeam transmitters and narrowbeam receivers. Thus, large hydrophone arrays are used with either time- or frequency-domain beamforming.

Wideband signals have been employed more recently to provide additional gain over reverberation, with matched filtering or replica correlation being used for signal detection. In order to prevent this detection process from becoming complicated by the Doppler shift induced in echoes from moving targets, Doppler insensitive waveforms such as hyperbolic frequency modulation (HFM) have traditionally been used. Although HFM is Doppler insensitive and acceleration tolerant so that detection under all circumstances (signal-to-noise permitting) is possible, it does not provide the extra target discrimination achievable with Doppler sensitive waveforms.

Most recently, Doppler sensitive waveforms are being reexamined in order to provide this greater target discrimination; however, there is a penalty to be paid—substantially greater computational load in the form of correlation against each of the Doppler shifted replicas.

Correlation and the related process of convolution or matched filtering are primary signal processing techniques used to detect signals in noise, perform synchronization of coded waveforms, or perform pulse compression. Correlation of the two waveforms, $s_1$ and $s_2$ may be expressed by the integral:

$$r(\tau) = \int_{-\infty}^{\infty} s_1(t) \cdot s_2(t+\tau)\, dt.$$

This integral may be readily performed electronically on two waveforms for a single value of delay, $\tau$. In order to perform this correlation simultaneously for many values of $\tau$, a tapped delay line and parallel mixers and integrators are generally required. Even for this configuration, the number of parallel delays must be limited by the multiplicity of components required. This integral may be performed digitally either directly or through the use of algorithms involving fast Fourier transforms. For digital processing, the processing time and hardware required depend greatly upon the bandwidth and duration of the signals to be processed. Acousto-optic signal processing techniques may be used very effectively and efficiently to perform correlation.

FIG. 1 shows illustrates the diffraction of a laser beam by a conventional acousto-optic Bragg cell 10. The light diffracted from a broad beam of incoming light by a traveling acoustic wave of modulation B(t) moving at velocity v in the z-direction obtains the spatial modulation B(t+z/v) across its wavefront. Since delay $\tau$ may be related to z/v, both correlation and convolution may be performed by integrating either in time (t) or in space across the wavefront ($\tau$) respectively. Correlation may be performed using a convolver and a time-inverted reference, so that correlation may be accomplished using either the time-integrating or space-integrating architectures. For correlation involving signals with time-bandwidth products under $10^4$, space integrating architectures are usually most practical.

The basic AO space-integrating convolver 20 is shown in FIG. 2. This is a surface acoustic wave (SAW) implementation in which two Bragg cells 21 and 22 are incorporated onto one substrate. A broad incoming light beam traveling at the Bragg angle $2\theta_B$ interacts with an acoustic wave S(t) cos ($\omega_a$t) in Bragg cell 21 which diffracts a portion of that beam. The undiffracted light next interacts with an acoustic wave R(t) cos ($\omega_a$t) in Bragg cell 22 which also diffracts a portion of that input beam. These diffracted beams have amplitudes proportional to:

$$R(t-z/v)\cos(\omega_l+\omega_a)t \text{ and}$$

$$S(t+z/v)\cos(\omega_l-\omega_a)t$$

where z is the position along the acoustic wavefront, v is the acoustic velocity, $\omega_a$ is the acoustic frequency and $\omega_l$ is the light frequency. The frequency shifts of these diffracted beams are opposites, since they result from a positive first order diffraction and a negative first order diffraction respectively. The diffracted beams are then focused by a lens 23 to fall on a single wide-area photodetector 24. The resulting photocurrent I will be proportional to the square of the sum of there light amplitudes integrated over the area (space) of the photodetector 24 (hence the name space-integrating convolver). Thus, $$I \propto \int_Z [R(t-z/v)\cos(\omega_l+\omega_a)t + S(t+z/v)\cos(\omega_l-\omega_a)t]^2\, dz.$$

The square of the sum contains two square terms, $$R^2(t-z/v)\cos^2(\omega_l+\omega_a)t$$

and $$S^2(t+z/v)\cos^2(\omega_l-\omega_a)t,$$

and a cross-product term, $$2R(t-z/v)\,S(t+z/v)\cos(\omega_l+\omega_a)t\cos(\omega_l-\omega_a)t.$$

The cross-product term may be manipulated into frequency sum and difference terms, $$R(t-z/v)\,S(t+z/v)\cos 2\omega_l t$$

and $$R(t-z/v)\,S(t+z/v)\cos 2\omega_a t.$$

The convolution output is obtained from this frequency difference term. The photodetector 24 cannot respond to the frequency sum term (at twice the light frequency). The square terms result in a DC bias (which may be removed by high pass filtering) and additional terms at twice the light frequency. The convolver output is then:

$$I(t) \propto \cos 2\omega_a t \int_Z R(t-z/v)\,S(t+z/v)\,dz.$$

By a change in variables, this may be written as:

$$I(t) \propto \cos 2\omega_a t \int_Z S(z'/v)\,R(2t-z'/v)\,dz,$$

and further as:

$$I(t) \propto \cos 2\omega_a t \int_T S(\tau)\,R(2t-\tau)\,d\tau$$

which is the more familiar convolution integral in a compressed time frame on an RF carrier.

Additionally, a "doubly diffracted" beam results from the subsequent diffraction of the diffracted beam from Bragg cell 21 by the acoustic wave in Bragg cell 22. This doubly diffracted beam has an amplitude proportional to:

$$R(t-z/v)\,S(t+z/v)\cos(\omega_l+2\omega_a)t$$

Since the two acoustic waves are at the same carrier frequency, Bragg angles are equal and opposite for the two successive diffractions, so that the doubly diffracted beam is colinear with the undiffracted beam. As with the two first order diffractions, these beams may be focused by a lens 25 onto a large area photodetector 26 with a resulting frequency difference cross product output photodetector current that is proportional to that of the previous case with differences only in scale factor due to differing diffraction efficiencies and in DC bias terms.

In order to use the AO convolver as a replica correlator, it is necessary to input the signal to one Bragg cell and the reference in time-inverted format to the other Bragg cell. In using Doppler sensitive waveforms, the signal must be correlated repeatedly against the reference each time modified for a different degree of Doppler. Since Doppler exhibits itself as a time compression or expansion of the waveform, it is necessary to produce such changes in the reference; if the reference is stored in memory in digital form, it is only necessary to convert the reference from digital to analog (D/A) at a different conversion rate. Since a typical wideband SONAR signal may have a 300 Hz bandwidth at 100–1000 Hz and AO processors require signals in the 10–1000 MHz range, the digital SONAR signals are stored digitally in a buffer memory and read-out through a high speed digital-to-analog converter so that such a signal would be input to the AO convolver at 100 MHz with 30 MHz bandwidth. In this way, signals of several seconds duration are time-compressed (frequency expanded) to signals of 10–100 μsec and processed in real time allowing over 100,000 different correlations to take place during those several seconds duration. Since the AO convolver operates in real time, a two (2) second signal would be processed in about 40 μsec (to allow signal loading and unloading time in the Bragg cell), and 50,000 correlations may be performed in real time (enough for many beams and Doppler bins).

A one-dimensional AO correlator system was proposed employing the techniques described above with respect to AO convolution. An example of the 1-D AO correlator is shown in FIG. 3 and is designated generally by the reference numeral 30. The structure of 1-D AO correlator 30 is the same as that of AO convolver 20 except that a signal is input to one Bragg cell 21 and the reference signal is input in time-inverted format to the other Bragg cell 22.

Although this 1-D correlator system was shown to be capable of 50,000 correlations in real time, many scenarios are readily developed for which the processing load greatly exceeds this capability. Consider the velocity range of a target to be ±75 knots. For a two second SONAR ping at 1000 Hz, the Doppler coverage is (2 v/c)f, where v is the target velocity range, c is the sound velocity, and f is the signal frequency, which is: [(2) (±75 knots)/(3000 knots)] (1000 Hz)=±50 Hz with [1/(2 sec)] or 0.5 Hz resolution creating 200 Doppler bins. With a 1.5 Doppler overlap, 300 bins are required. If the beamformer generates 300 beams, then 300 beams×300 Doppler bins=90,000 replica correlations are required. In addition, acceleration producing maneuvers such as turning with a radius of 0.5 miles must be considered. Such a maneuver would span 8 Doppler bins. Thus the number of replica correlations required to include such maneuvers would increase the above figure by a factor of 8, to 720,000 correlations. One may readily show that for this scenario, a digital signal processor would be required to perform of 70.8 ×10 operations per second.

Since the 1-D correlator 30 was unable to attain this processing rate, 2-D processing must be explored. In radar, narrowband Doppler approximation is made in order to perform 2-D AO correlations with time bandwidth products exceeding $10^6$ covering many Doppler bins. This narrowband approximation treats the Doppler shift as a constant frequency shift across the entire signal bandwidth. In SONAR, the velocity of sound in the sea does not permit this. For a wideband signal at frequency f with bandwidth Δf, the Doppler shift at the lower band edge is:

$$f=(f-\Delta f/2)(2v/c)$$

and at the upper band edge is:

$$f'=(f+\Delta f/2)(2v/c).$$

The difference between f' and f'' is (2 v/c)Δf. Since there must be less than 360° of relative phase shift for the upper end of the signal band with respect to the lower end during the integration interval, the time-bandwidth product limitation may be found by setting: $(2\ v/c)\Delta fT<1$ where T is the integration interval. Thus the time-bandwidth product $\Delta fT<(c/2\ v)$. For the current example, a 300 Hz bandwidth with 2 second integration, a 600 time-bandwidth product (TBP), could only be processed over ±2.5 knots. Thus, a two-dimensional correlator using the narrowband approximation could only process 10 simultaneous Doppler bins (15 considering overlap). If this were acceptable, a new Doppler modified reference could be used for each ±2.5 knot segment of an overall ±75 knot target velocity range.

SUMMARY OF THE INVENTION

Accordingly, the present invention has been made in view of the above circumstances and has as an object to provide a correlator which is capable of true Doppler (time compression/expansion) processing of SONAR signals.

An additional object of the present invention is to provide a correlator which is capable of processing either single band or multiband signals.

A further object of the present invention is to provide a correlator which is capable of processing 50 to 100 billion operations per second.

Another object of the present invention is to provide a correlator that is small in size, weight, and power consumption, and is low in cost.

Additional objects and advantages of the invention will be set forth in part in the description which follows and in part will be apparent from the description, or may be learned by practice of the invention. The objects and advantages of the invention may be realized and attained by means of the instrumentalities and combinations particularly pointed out in the written description and claims hereof as well as the appended drawings.

To achieve these and other objects and advantages and in accordance with the purpose of the invention, as embodied and broadly described herein, the apparatus of this invention comprises light beam generating means for generating collimated first and second light beams, a first light modulator for modulating the first light beam with a signal, a second light modulator for modulating the second light beam with a reference signal, first lens means, positioned in an optical path of the second light beam, for introducing into the second light beam horizontal magnification/demagnification which gradually varies with respect to a vertical direction, a beam combiner for combining the first and second light beams, and photodetecting means for detecting the combined light beam received from the beam combiner.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification illustrate several embodiments of the invention and, together with the description, serve to explain the objects, advantages, and principles of the invention. In the drawings, FIG. 1 is an isometric view of a conventional acousto-optic Bragg cell;

FIG. 2 is an isometric view of a conventional acousto-optic space-integrating convolver;

FIGS. 6(*a*) and 6(*b*) are top views of a pair of cylindrical lenses which constitute a part of the second embodiment of the present invention;

FIGS. 9(*a*) through 9(*c*) are diametric illustrations of the processing at sequential time intervals of a signal and reference applied to a one dimensional AO correlator having an aperture 2Δt wide;

DETAILED DESCRIPTION OF THE PREFERRED EMBODIMENTS

Reference will now be made in detail to the present preferred embodiments of the invention, examples of which are illustrated in the accompanying drawings.

Figure 4:
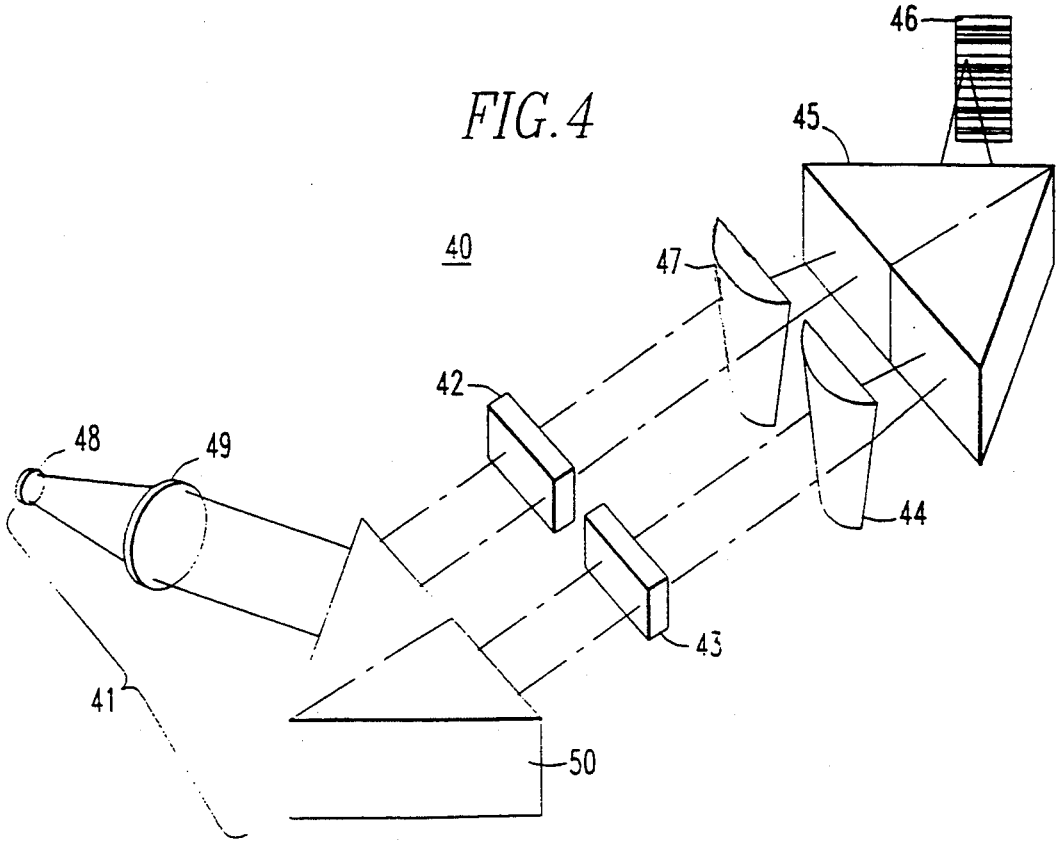
FIG. 4 is an isometric view of an optical correlator constructed in accordance with a first embodiment of the present invention.

A first exemplary embodiment of the optical correlator of the present invention is shown in FIG. 4 and is designated generally by the reference numeral 40. Optical correlator 40 is a 2-D wideband AO correlator which includes light beam generating means 41, a first light modulator 42, a second light modulator 43, first lens means 44, a beam combiner 45, and photodetecting means 46. Additionally, optical correlator 40 may include second lens means 47. As will be explained below, the two dimensions are the linear array of photodetectors (a Doppler dimension), each outputting information in time (time delay between signal and reference from which range is derived).

The details of the above described invention are hereinafter described.

The term "light beam generating means" as used and embodied herein includes any structure capable of generating two collimated light beams, preferably light beams propagating in parallel. In the preferred embodiments, light beam generating means 41 includes laser diode 48, collimating optics 49, and a beamsplitter 50 such as a beam splitting prism.

First light modulator 42 modulates the first of the two light beams generated by light beam generating means 41 with a signal. Second light modulator 43 modulates the second light beam with a reference signal. First and second light modulators 42 and 43 are preferably acousto-optic modulators such as Bragg cells or the like.

First lens means 47 is positioned in an optical path of the second light beam, and introduces into the second light beam horizontal magnification/demagnification which gradually varies with respect to a vertical direction. In the first embodiment of the present invention first lens means 47 is described as preferably being a conical lens positioned in the path of the second light beam such that its axis is tilted with respect to the direction of the propagation of the incident second light beam. In the first embodiment, first lens means 44 also functions to horizontally focus the second modulated light beam.

Second lens means 47 is positioned in an optical path of the first modulated light beam between first light modulator 42 and beam combiner 45. In the first embodiment, second lens means 47 preferably includes a cylindrical lens for horizontally focusing the first modulated light beam.

Beam combiner 45 combines the first and second light beams and projects the combined light beams onto photodetecting means 46. Beam combiner 45 is preferably a beam splitting prism or the like.

Photodetecting means 46 detects the combined light beam received from beam combiner 45 and outputs an electrical current proportional to the intensity of the combined beam. In the first embodiment photodetecting means 46 is a vertically disposed one-dimensional array of photodetectors. Due to the horizontal focusing of the first and second light beams introduced by the first and second lens means 44 and 47, respectively, the combined light beam may be focused onto the vertically disposed one-dimensional array of photodetectors.

A second embodiment of the invention will now be described with reference to FIG. 5 where like or similar parts are identified throughout the drawings by the same reference characters.

Figure 5:
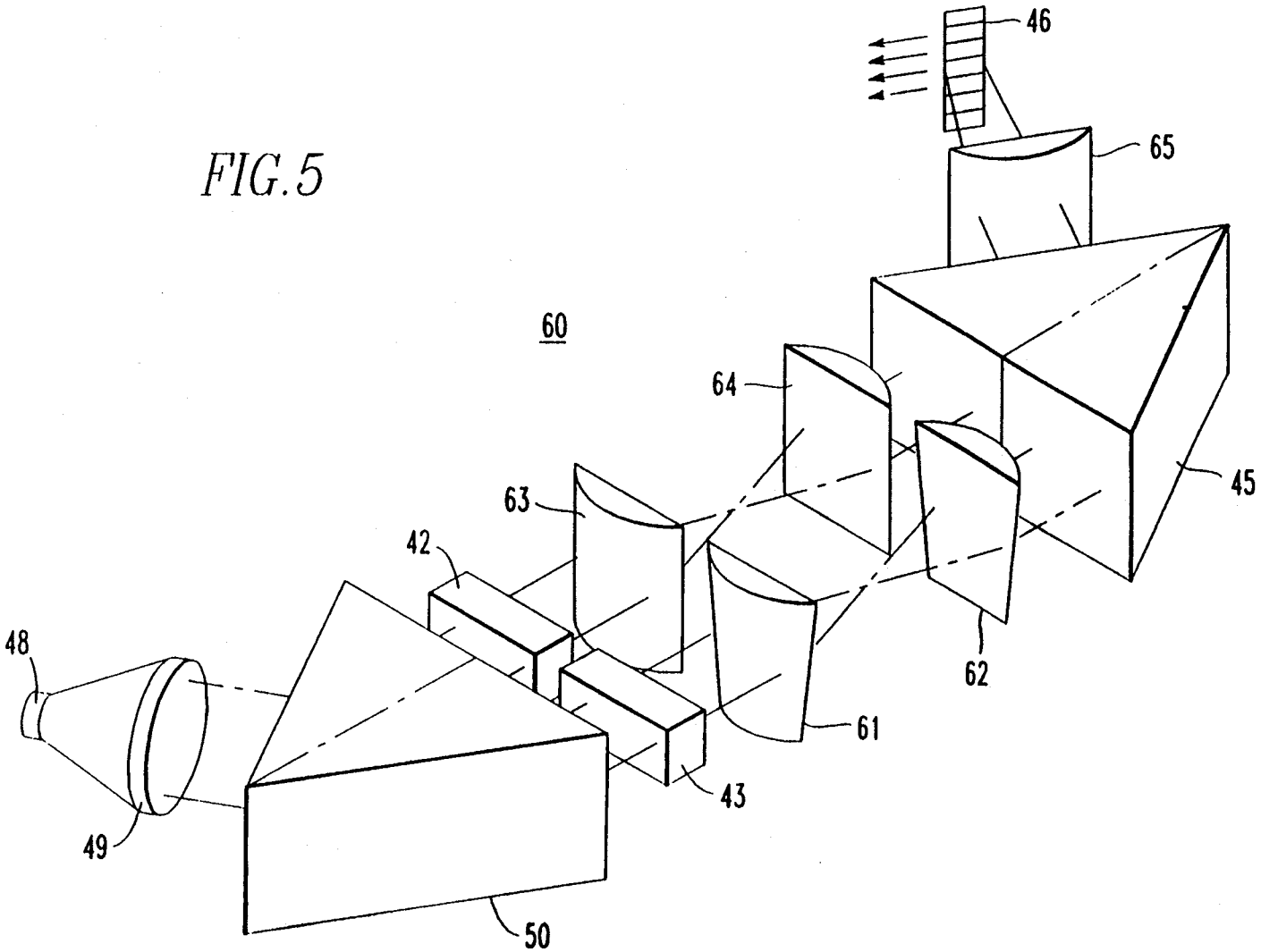
FIG. 5 is an isometric view of an optical correlator constructed in accordance with a second embodiment of the present invention.

FIG. 5 shows the optical correlator of the second embodiment of the present invention which is designated generally by the reference numeral 60. Optical correlator 60 is a 2-D wideband AO correlator which, like the optical correlator 40 of the first embodiment, includes light beam generating means 41, a first light modulator 42, a second light modulator 43, first lens means 44, a beam combiner 45, and photodetecting means 46. Additionally, optical correlator 60 may include second lens means 47.

Optical correlator 60 differs from the previously described optical correlator 40 in that the first lens means 44 includes first and second conical lenses 61 and 62 which are axially tilted at an angle with respect to the vertical direction, and the second lens means 47 includes first and second cylindrical lenses 63 and 64. In the second embodiment the first and second lens means 44 and 47 vertically expands and reimages the respective first and second modulated light beams. However, unlike in the first embodiment, in the second embodiment the first and second lens means 44 and 47 do not horizontally focus the respective first and second light beams onto the vertical array of photodetectors constituting the photodetecting means 46. Rather, in the second embodiment, a cylindrical lens 65 is positioned between beam combining means 45 and photodetecting means 46 for the purpose of horizontally focusing the combined light beam onto the photodetecting means 46.

Although the optical correlators of the present invention may be utilized in various technical applications, the use of the present invention for correlating SONAR signals will now be described with reference to the first and second embodiments of the present invention.

Sonar signals with, for example, 200 Hz bandwidth at 700 Hz center frequency and 2 second duration may be time compressed by very high speed digital-to-analog conversion to become 70 MHz signals with 20 MHz bandwidth and 20 μsec duration. In this way, thousands of correlations covering many sonar beams, Doppler channels, and orthogonal pulses may be processed in parallel using the architecture of FIG. 5. The signal (sonar echo) modulates the first light beam which is spread vertically by second lens means 47. The reference, a copy of the transmitted sonar signal, modulates the second light beam which passes through the pair of tilted conical lenses 61 and 62 which time compress/expand the reference signal in the same manner as the Doppler effect, over a range of Doppler. The first and second light beams representative of the signal and reference are overlaid by beam combiner 45 and focused by cylindrical lens 65 onto photodetecting means 46, where matching signal and reference give the required large correlation on a particular photodetector element for a particular Doppler channel.

In the optical system shown in FIG. 6(*a*), which consists of a pair of cylindrical lenses 71 and 72 similar to the pair of cylindrical lenses 63 and 64 of the second lens means 47, the system magnification is $f_2/f_1=H_2/H_1$. In the same optical system which is shown in FIG. 6(*b*) , when off-axis parallel rays are input, the angular magnification (demagnification) will be $f_1/f_2=\Phi_2/\Phi_1$, the reciprocal of the system magnification. These considerations are fundamental to the spectral shift compensation of the 2-D AO sonar correlator.

Doppler effects a signal as a time scaling—compression or expansion. In radar, where bandwidths are relatively small with respect to center frequencies, the Doppler effect is often considered merely a frequency shift. In SONAR, however, bandwidths may be relatively large, and Doppler must be treated as a time compression or expansion of the signal. Consider the time scaling property of the Fourier transform:

$$f(t) \longleftrightarrow F(\omega)$$

For a signal f(t) scaled by Doppler to f(αt), the spectrum becomes:

$$f(\alpha t) \longleftrightarrow (1/\alpha)F(\omega/\alpha)$$

A signal centered at $\omega_o$ undergoing a Doppler compression of $\alpha$ will now be centered at $\omega_o/\alpha$.

On the signal side of the AO sonar correlator shown in FIG. 5, the modulated first light beam has an output (diffraction) angle proportional to frequency. Since the center frequency of this Doppler-affected sonar return is a function of the Doppler compression, different diffraction angles may be encountered (depending on the velocity of the target producing the echo). On the reference side, only one center frequency, that of the transmitted signal, is input; thus, only one diffraction angle is possible. If the diffracted beam enters the first lens means 44 on-axis, all magnifications/demagnifications exit on-axis.

Since the signal diffraction is proportional to frequency, which is inversely proportional to Doppler scaling, an on-axis conical lens system as the first lens means 44 will not allow Doppler-affected signals to overlay reference signals for all Doppler-scaling covered. However, if the diffracted second light beam enters the conical lens system off-axis (at the non-Doppler Bragg angle), the output angles become inversely proportional to magnification (time scaling); thus, signal and reference will overlay for any Doppler. Mathematically, the Bragg angle is proportional to frequency: $\Phi_B(\omega)\approx\beta\omega$, where $\beta$ is a proportionality constant. For sonar transmit frequency $\omega_o$ (after time compression to optical processing frequencies), the Bragg angle on the correlator signal side is $\Phi_B(\omega_o/\alpha)\approx\beta\omega/\alpha$, where $\alpha$ is the Doppler time scaling factor. The Bragg angle on the reference side of the correlator is $\Phi_B(\omega_o)\approx\beta\omega_o$. If this is the off-axis angle to the first lens means 44, at the vertical position which produces a magnification of $\alpha$, the magnification required to match Doppler time scaling of the sonar echo, the output angle will be $\beta\omega_o/\alpha$, which matches the angle on the sonar signal side. Thus, focused beams will overlay on the photodetector array element for that Doppler channel.

As stated above, the demagnification/magnification of the second light beam representing the reference produces the required number of Doppler modified references through optical expansion or compression of the reference waveform. If thirty Doppler bins are covered, then the signal is repeated 10 times while the reference is also repeated but at different D/A conversion rates in order to cover 300 Doppler bins. Other basic reference waveforms would be available to cover acceleration producing maneuvers. With only 10 repetition clock rates, discrete crystal oscillators may be used to simplify the electronics subsystem.

The multichannel processor electronics will in general provide advantages over the single channel (1-D) electronics in several areas. In addition to the potential use of discrete crystal clocks due to the much smaller number of clock rates required, multiple Doppler correlations will be available simultaneously (in parallel), thus permitting the use of adjacent Doppler bin data for normalization purposes without requiring storage. The memory buffer will make use of low-speed, low-power memories multiplexed to provide the high D/A rates required. Since 300 megasamples per second, 8-bit D/A converters are readily available, a SONAR signal at 1000 Hz with 300 Hz bandwidth may be sampled at 3000 samples per second for a rate of 2.6 times the highest frequency to be examined (1150) and may be frequency expanded in the correlator system to 300 ms/s for an output at 100 MHz with 30 MHz bandwidth. Since the sea will only support time-bandwidth products of up to about 1000, 8 bits, which will provide 48 dB of dynamic range, will be sufficient. Dynamic ranges may exceed 30 dB in various portions of the system, but since the correlator can only provide 30 dB processing gain (the TBP), beamforming and other techniques must bring the signal to within 30 dB of the noise prior to correlation. At the correlator system input, automatic gain control is performed by accepting the appropriate 8 bits from within the 16 (nominal) bits provided in advance of the correlator.

The correlator dynamic range may be estimated by an analysis of thermal and shot noise with respect to estimated signal and reference power considering laser output power and Bragg cell diffraction efficiency. Since single mode laser diodes with 30 milliwatt output power are available together with efficient Bragg cells for the frequency range to be used here, calculated dynamic range far exceeds the 30+ dB required here.

The use of such optical signal processors to process SONAR signals will permit system designers to take advantage of Doppler sensitive waveforms and still perform all of the required signal processing in real time.

A third embodiment of the invention will now be described with reference to FIG. 7 where like or similar parts are identified throughout the drawings by the same reference characters.

Figure 7:
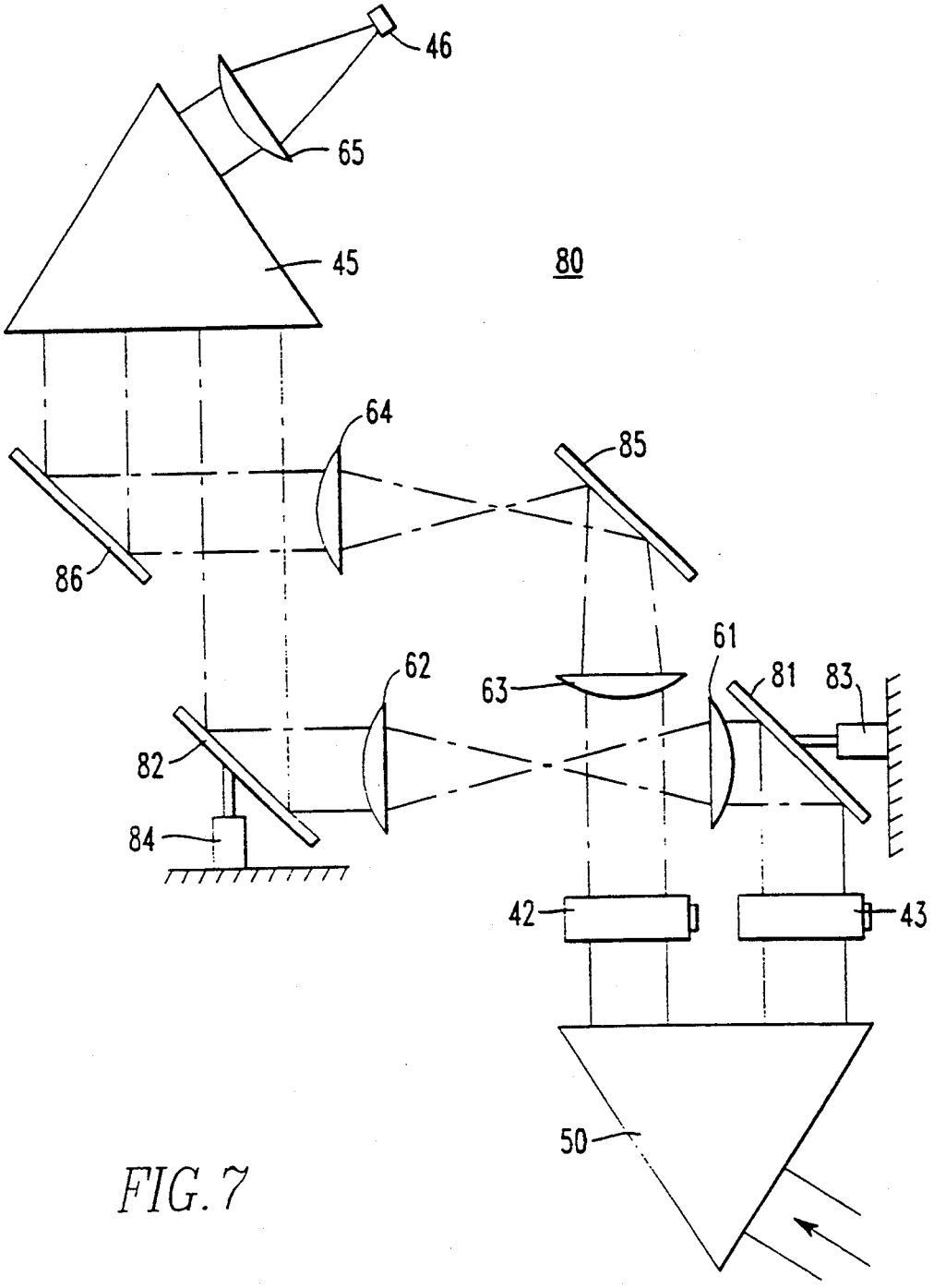
FIG. 7 is a top view of an optical correlator constructed in accordance with a third embodiment of the present invention.

FIG. 7 shows the optical correlator of the third embodiment of the present invention which is designated generally by the reference numeral 80. Optical correlator 80 is a 2-D heterodyne AO correlator which, like the optical correlator 60 of the second embodiment, includes light beam generating means 41, a first light modulator 42, a second light modulator 43, first lens means 44, second lens means 47, a beam combiner 45, a cylindrical lens 65, and photodetecting means 46.

The description of the first and second embodiments have shown that, if sonar signals are time compressed from sonar frequencies to RF (acousto-optic processing frequencies), they may be effectively processed in the AO sonar correlator. However, future sonar systems which are candidates for AO processing may use multiple frequency bands. In this case, pulses may be transmitted, for example, at 700 Hz and at 1000 Hz, each with 200 Hz bandwidth. The signal at 700 Hz may be time compressed by $10^5$ to 70 MHz with 20 MHz bandwidth, compatible with readily available AO Bragg cells. The signal at 1000 Hz might only be compressed by $0.7\times10^5$ to 70 MHz with a 14 MHz bandwidth and a longer pulse length, thus complicating processing.

It would seem logical to first down-convert the signal at 1000 Hz to 700 Hz before time compressing, so that a $10^5$ compression factor may also be used. However, when heterodyning (down-conversion or up-conversion) is employed, the Doppler "shift" is no longer inversely proportional to the Doppler time compression. For example, a sonar spectrum about $\omega_o$ maps easily with high speed D/A conversion to the required Bragg cell center frequency. If the sonar spectrum is also at $\omega_o+\omega_1$, it may first be down converted to $\omega_o$ for easy speed-up to AO frequencies. Since the amount of Doppler in the sonar echo is unknown, the down-conversion used is $-\omega_1$. If the Doppler time compression on the echo was $\alpha$, then the original spectrum centered at $\omega_o+\omega_1$ was "shifted" to $(\omega_o+\omega_1)/\alpha$ and is now down-converted to:

$$(\omega_o+\omega_1)/\alpha-\omega_1=[\omega_o/\alpha+\omega_1(1-\alpha)/\alpha]$$

This is input to the first light modulator 42. For Bragg angle $\Phi_B(\omega)\approx\beta\omega$, the output Bragg angle on the signal side is $\beta[\omega_o/\alpha+\omega_1(1-\alpha)/\alpha]$. On the reference side, the reference spectrum is centered at $\omega_o$, having been down-converted from $\omega_o+\omega_1$. Following the first lens means 44, which alters the apparent Bragg angle, and at the vertical position producing a time compression factor of $\alpha$, the equivalent reference Bragg angle is approximately $\beta\omega_o/\alpha$. It is apparent that, when overlaid, the first and second light beams representing the signal and reference will have an angular offset of approximately $\beta\omega_1(1-\alpha)/\alpha$ between them.

A potential solution to this problem is to introduce an additional angular offset equal to the Bragg angle for $\omega_1$, approximately $\beta\omega_1$, on the reference side prior to the first lens means 44. In this way, the input angle to the first lens means 44 will be about $\Phi_B(\omega_o+\omega_1$. Following the first lens means 44, at the vertical position of time compression $\alpha$, the output angle will be $\beta(\omega_o+\omega_1)/\alpha$. Next, an angular change of $-\beta\omega_1$ is introduced after the first lens means 44. The resulting offset will be:

$$\beta(\omega_o+\omega_1)/\alpha-\beta\omega_1=\beta[\omega_o/\alpha+\omega_1[1-\alpha)/\alpha_1]$$

This now matches the Bragg angle on the signal side.

These angular changes may be viewed as modifying the architecture of the second embodiment shown in FIG. 5 as follows. Down-converted signal and reference are applied to the first and second light modulators 42 and 43. The second light beam output from the second light modulator 43 is then "optically up-converted" by the angular change caused by a first adjustable mirror 81 inserted before the first lens means 44 (which create the range of Doppler references). By restoring the diffraction angle of the modulated second light beam to the Bragg angle for the compressed center frequency had there been no frequency conversion, the conical lenses 61 and 62 of the first lens means 44 correctly adjust this angle for Doppler. Having restored this center frequency with the first angular change, another angular change is introduced after the first lens means 44 by a second adjustable mirror 82 to "optically down-convert" the Doppler-adjusted beam to match the first light beam. Thus, just as the sonar pulse was transmitted, Doppler-affected, and down-converted (although prior to being input to the first light modulator 42), so too, the reference (after being frequency restored) is Doppler-adjusted, and down-converted (but performed after being input to the second light modulator 43).

The angular changes added to the system are independent of actual Doppler time compression, $\alpha$, so that the angular correction will be effective over the entire range of $\alpha$ for the 2-D AO sonar correlator 80. If different down-conversions are used to process multiple bands, then several angular adjustments may be necessary for sequential correlations. These adjustments, which must be electronically programmable, may be accomplished with adjustable mirrors 81 and 82 adjusted rapidly ($\approx$1 msec) using piezo-electric translators/rotators 83 and 84 driving the platforms of adjustable mirrors 81 and 82 as shown in FIG. 7. Here, the piezo-electric expansion/contraction is converted into a rotation of adjustable mirrors 81 and 82 with respect to the second light beam.

First and second fixed mirrors 85 and 86 are placed in the path of the first light beam at 45° angles so as to redirect the first light beam to parallel the second light beam.

The 2-D heterodyne AO correlator 80 of the present embodiment performs true Doppler (time compression-/expansion) processing. The equivalent of more than 50 billion operations per second may be performed using the correlator of the third embodiment. The correlator of the third embodiment is further advantageous in that multiband signals may be processed using the same time compression/frequency expansion ratios to convert from sonar to AO processing frequencies, and no manual mechanical adjustments are required in changing frequency bands. Furthermore, the correlator may be fabricated with small size and weight, low power requirements, at relatively low cost.

A fourth embodiment of the invention will now be described with reference to FIG. 8 where like or similar parts are identified throughout the drawings by the same reference characters.

Figure 8:
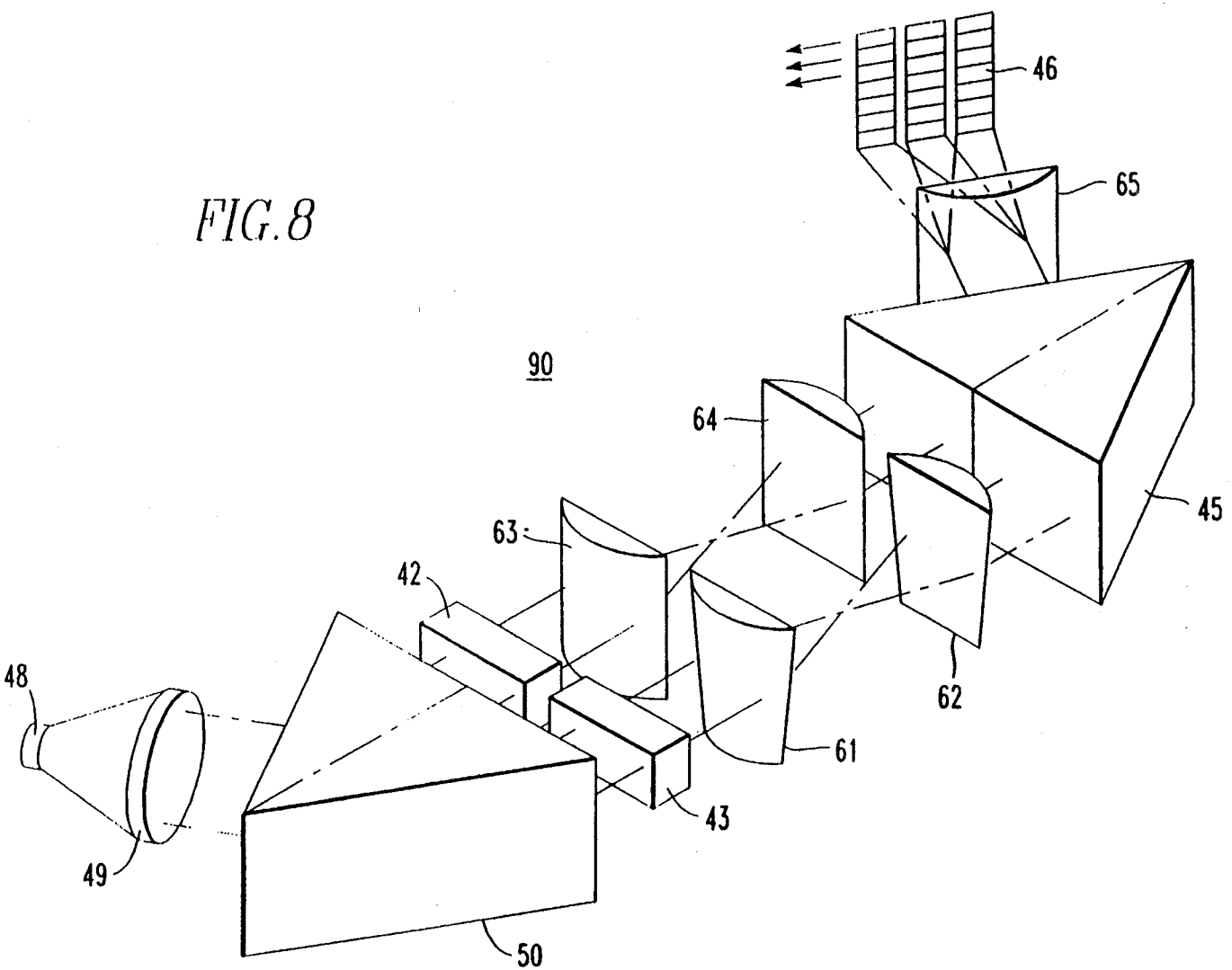
FIG. 8 is an isometric view of an optical correlator constructed in accordance with a fourth embodiment of the present invention.
Figure 10A:
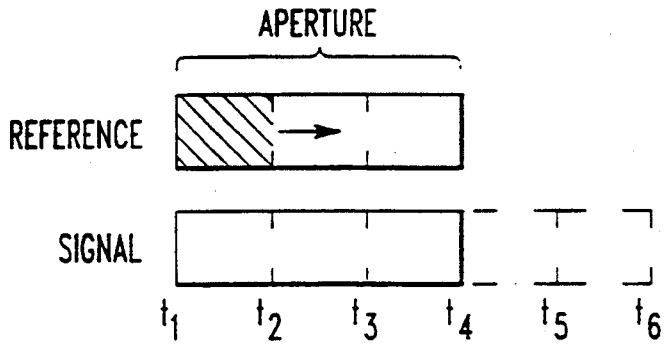
FIGS. 10(*a*) through 10(*e*) are diametric illustrations of the processing at sequential time intervals of a signal and reference applied to a one dimensional AO correlator having an aperture 3Δt wide.
Figure 10B:
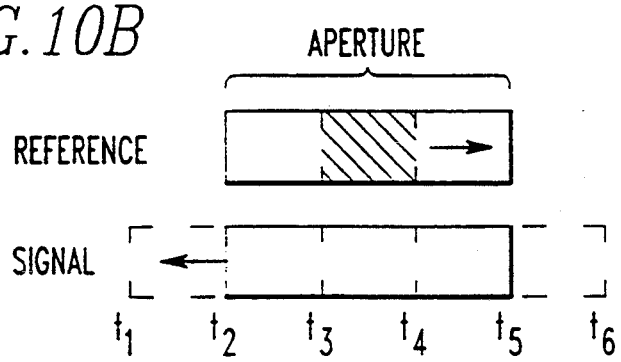
Figure 10C:
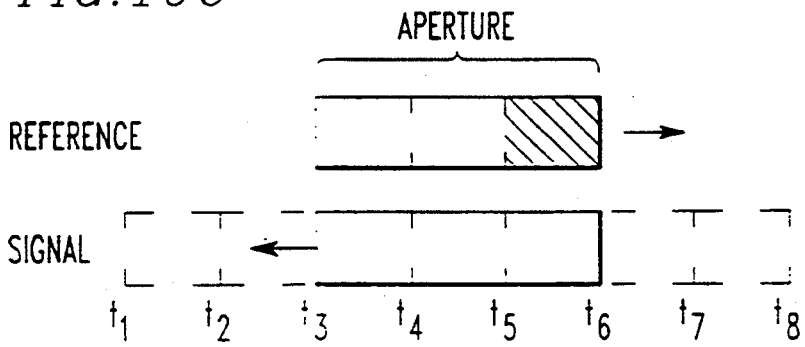
Figure 10D:
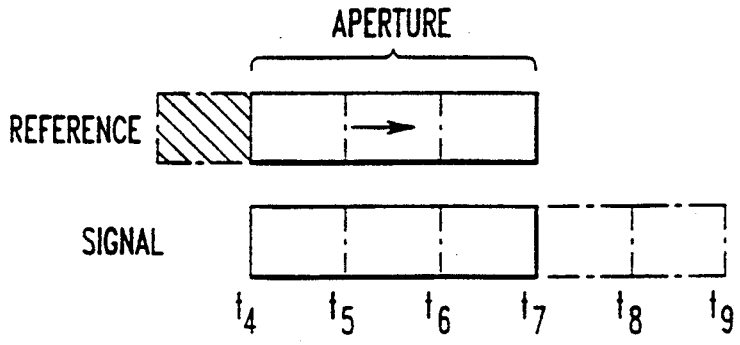
Figure 10E:
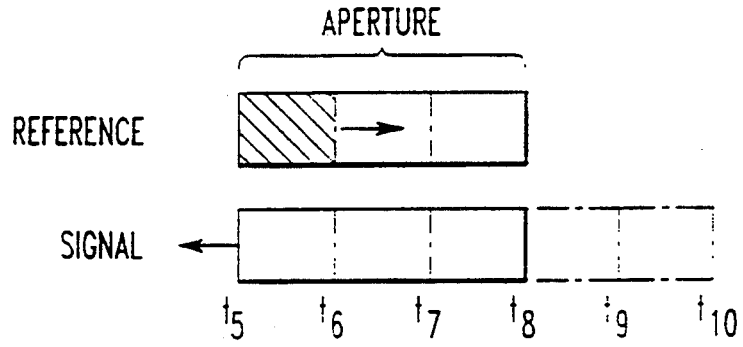

FIG. 8 shows the optical correlator of the fourth embodiment of the present invention which is designated generally by the reference numeral 90. Optical correlator 90 is a 3-D AO correlator which, like the optical correlator 60 of the second embodiment, includes light beam generating means 41, a first light modulator 42, a second light modulator 43, first lens means 44, second lens means 47, a beam combiner 45, a cylindrical lens 65, and photodetecting means 46.

The 3-D optical correlator 90 differs from the previously described 2-D optical correlator 60 in that photodetecting means 46 is modified to include a two-dimensional array of photosensing elements. For the reasons to be explained below with respect the use of this embodiment for SONAR signal processing, an additional column of the vertical array of photosensing elements is added for each additional frequency band to be processed.

SONAR signal processing is a highly intensive process due to the large number of directional beams provided by large hydrophone arrays. SONAR signal processing becomes even more intensive with the use of Doppler sensitive waveforms. Another factor increasing the processing load is the use of multiband signals, i.e. simultaneous pulses (pings) in the water at the same time, each in a different frequency band with an orthogonal waveform. The signals in each band may be processed sequentially, or a 3-D processor may be used to extend the 2-D processor into a third dimension (a second spatial dimension)—frequency band.

Since the AO diffraction is proportional to frequency, the spatial location of each signal band will differ. Thus, a 2-D array of photodetectors may then replace the 1-D array as shown in FIG. 8. Each vertical column will represent a different frequency band, with elements within each column representing Doppler band and time of correlation at a detector element representing range.

The total multiband signal spectrum must be time compressed to map into the AO processor's bandwidth and aperture. Multiple vertical columns of photodetectors may be used, positioned to accept the multiple bands of data. Thus, multiband signals may be processed in parallel, with outputs for each band over both Doppler and range.

Figure 3:
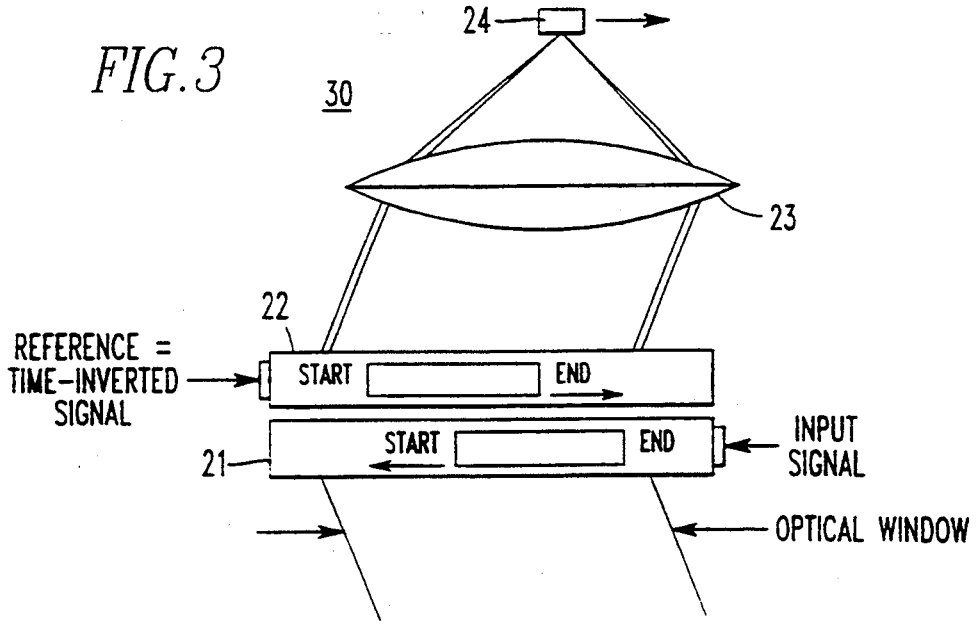
FIG. 3 is a top view of a conventional acousto-optic correlator.

Before the fifth and sixth embodiments will be described, it is first necessary to discuss the processing capability of the basic one dimensional correlator shown in FIG. 3.

In order to obtain accurate and complete correlation at a specific instant in time, the full reference pulse must be on the reference Bragg cell 22. FIGS. 9(*a*)–(*c*) illustrate an example of the operation of the basic one dimensional correlator wherein at time $t_1$, data begins to enter the signal Bragg cell 21, and at time $t_2$ ($t_2=t_1+\Delta t$, $t_3=t_2+\Delta t\ldots$, etc.), a reference pulse having a duration of $\Delta t$ begins to enter the reference Bragg cell 22. Thus, at time $t_3$, the full reference pulse will have entered the reference Bragg cell 22. At the time the full reference pulse has entered the reference Bragg cell 22, the data on the signal Bragg cell 21 is from some time $t_1$ through $t_1$+the cell aperture in time. Therefore, assuming an aperture of $2\Delta t$, at time $t_3$, the reference and signal are as shown in FIG. 9(*a*).

As the reference pulse travels along the reference Bragg cell 22, new data enters the signal Bragg cell 21, and by time $t_4$, the correlator has searched for the end of the reference pulse from $t_2$ through $t_4$ as shown in FIG. 9(*b*).

From time $t_4$ to time $t_5$, the reference pulse exits the reference Bragg cell 22 while another copy is reloaded. No valid processing may take place during this time interval. At time $t_5$, processing resumes by searching for the end of the reference pulse starting at time $t_4$, which is the time point at which processing ended in the previous valid processing interval (FIG. 9(*c*)). Thus, from time $t_3$ through $t_4$, an interval of $\Delta t$, data of time $t_2$ through $t_4$ was processed (searched), a period of $2\Delta t$. However, a "dead time" from $t_4$ through $t_5$, an interval of $\Delta t$, was needed to unload and reload the reference pulse. Overall, data within a $2\Delta t$ interval of the signal was processed in a $2\Delta t$ time interval, so that continuous processing may be supported. However, if two orthogonal pulses may be in the water at the same time, another series of correlations must be performed sequentially or in another correlator.

FIGS. 10(*a*)–(*e*) illustrate another example of the operation of the basic one dimensional correlator wherein the Bragg cell aperture is increased from $2\Delta t$ to $3\Delta t$. In a manner similar to FIGS. 9(*a*)–(*c*), the full reference pulse has entered the reference Bragg cell 22 at time $t_4$ at which time processing starts by searching from time $t_2$ and (FIG. 10(*a*)) ends at time $t_6$, having searched through time $t_6$ (FIG. 10(*c*)). Again, time to unload and reload the reference pulse is needed (FIG. 10(*d*)) before processing may resume. Here, since the aperture is $3\Delta t$, the "dead time" is $2\Delta t$, so that processing resumes at time $t_8$ with data starting at $t_6$ (where the previous processing ended) (FIG. 10(*e*)). Again, continuous processing provides data within a $4\Delta t$ interval of the signal being processed (searched) against one reference pulse in a $4\Delta t$ time interval ($2\Delta t$ processing and $2\Delta t$ "dead time"). Thus, neither time nor increased processing is gained by merely increasing the aperture size.

Figure 11:
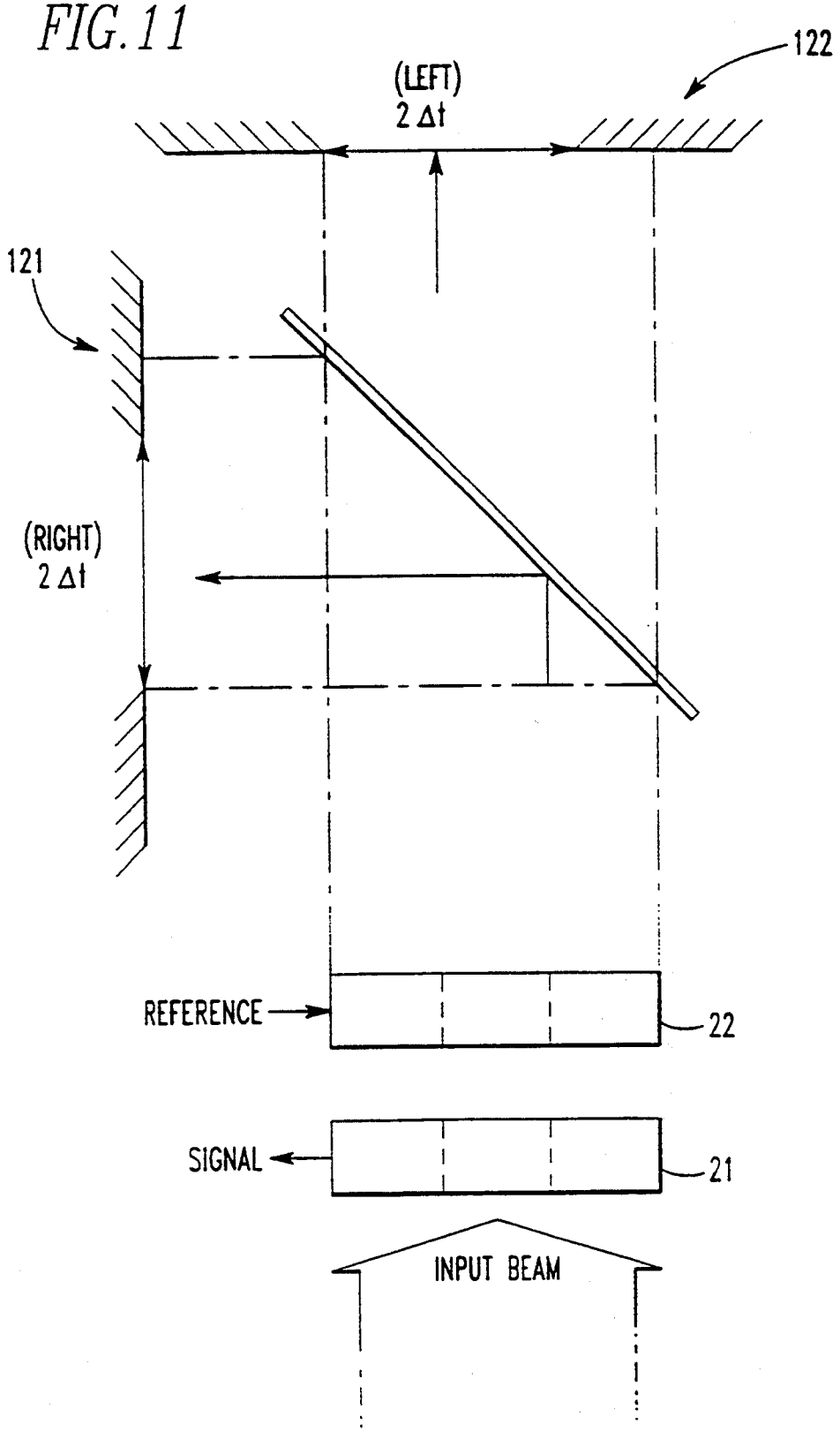
FIG. 11 is a graphic illustration of a split aperture architecture employed in a one dimensional AO correlator.
Figure 12A:
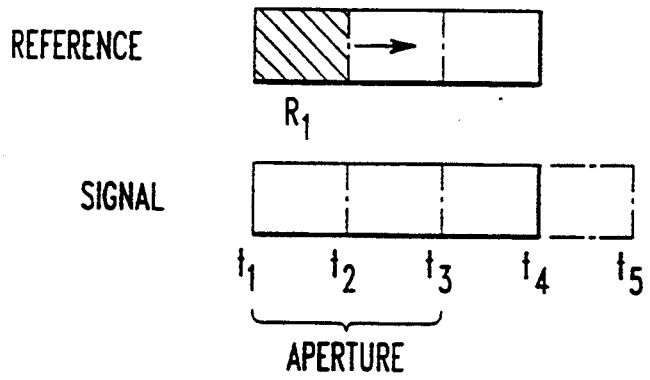
FIGS. 12(*a*) through 12(*f*) are diametric illustrations of the processing at sequential time intervals of a signal and reference applied to a one dimensional AO correlator having the split aperture architecture shown in FIG. 11.
Figure 12B:
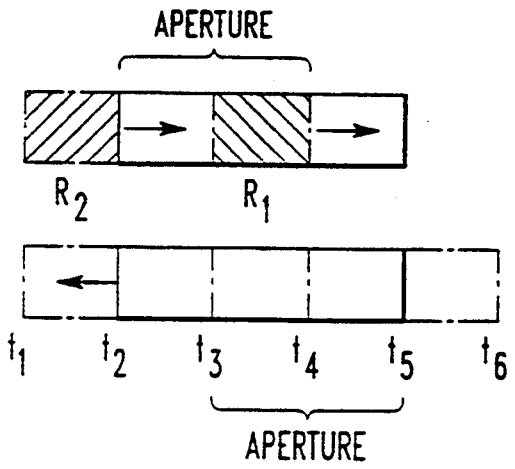
Figure 12C:
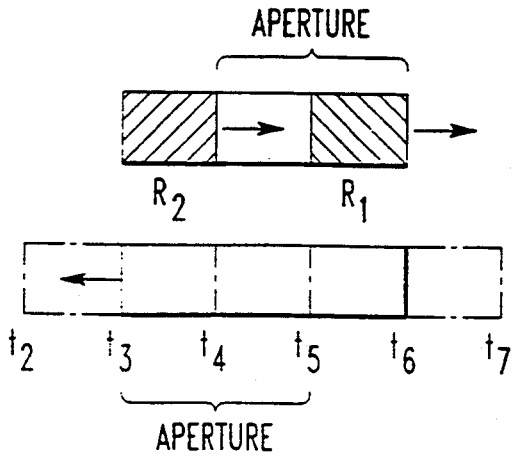
Figure 12D:
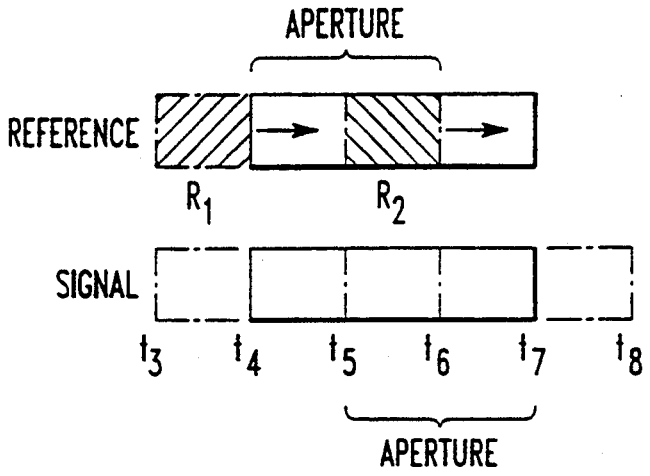
Figure 12E:
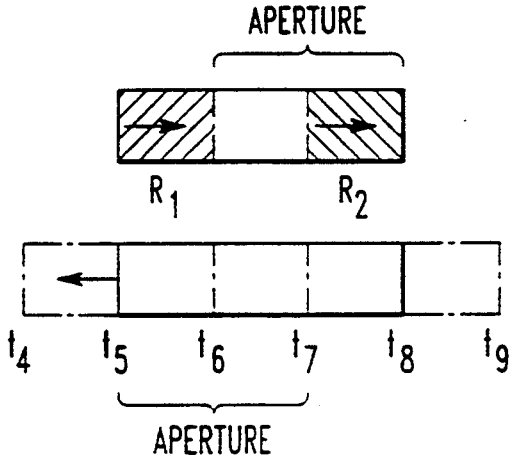
Figure 12F:
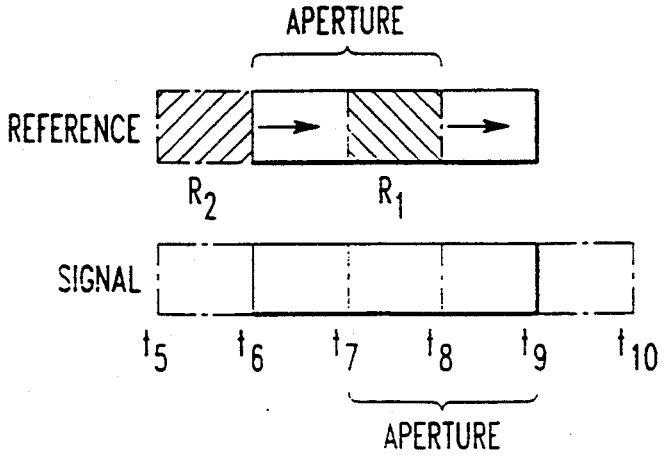

FIG. 11 shows a "split aperture" architecture utilized in a one dimensional correlator for comparative purposes. In the "split aperture" architecture, a single aperture of $3\Delta t$ is split and appropriately masked using first and second aperture stops 121 and 122 to provide two offset, overlapping apertures of $2\Delta t$ each.

FIGS. 12(*a*)–(*f*) illustrate the correlator processing for such a configuration in steps of $\Delta t$. As in the previous example utilizing a $3\Delta t$ aperture, a reference pulse $R_1$ has fully entered the reference Bragg cell 22 at time $t_4$ (FIG. 12(*a*)). Thus, processing of the left aperture 122 may begin at time $t_4$ with searching from data of time $t_2$.

As shown in FIG. 12(*b*), at time $t_5$, searching has been completed through data of $t_4$ using the left aperture 122 and output may now be obtained from the right aperture 121 starting with data from time $t_4$. Also, a second, different reference pulse $R_2$ starts to enter the unused portion of the left aperture 122 at time $t_5$.

FIG. 12(*c*) shows that at time $t_6$, processing in the right aperture 121 with the first reference pulse $R_1$ ends (through data of time $t_6$). Output may now be obtained from the left aperture 122, but with reference pulse $R_2$ and starting with data of time $t_4$. Reference pulse $R_1$ exits from the unused portion of the right aperture 121.

At time $t_7$, processing of reference pulse $R_2$ has been obtained through data of time $t_6$ using the left aperture 122, and output switches to that from the right aperture 121 and reference pulse $R_2$, starting at data of time $t_6$ (FIG. 12(*d*)). Reference pulse $R_1$ begins reloading into an unused portion of the left aperture 122.

As shown in FIG. 12(*d*), at time $t_8$, processing with reference $R_2$ in the right aperture 121 ends with data through time $t_8$, and output is switched to that of the left aperture with reference $R_1$ beginning with data of time $t_6$. Reference pulse $R_2$ exits from the unused portion of the right aperture 121.

FIG. 12(*e*) shows that at time $t_9$, processing in the left aperture 122 with reference $R_1$ ends (through data of time $t_8$) and the aperture switches to the right following the steps as previously described. Thus, two different reference pulses may be processed against a set of signal data with no processing gaps, and the data within a $4\Delta t$ interval of the signal is processed every $4\Delta t$ interval for each of the two reference pulses. Therefore, twice the processing of the single, unsplit aperture can be performed during the same time interval.

The fifth and sixth embodiments of the present invention will now be described with reference to FIGS. 13 and 14 where like or similar parts are identified throughout the drawings by the same reference characters.

Figure 13:
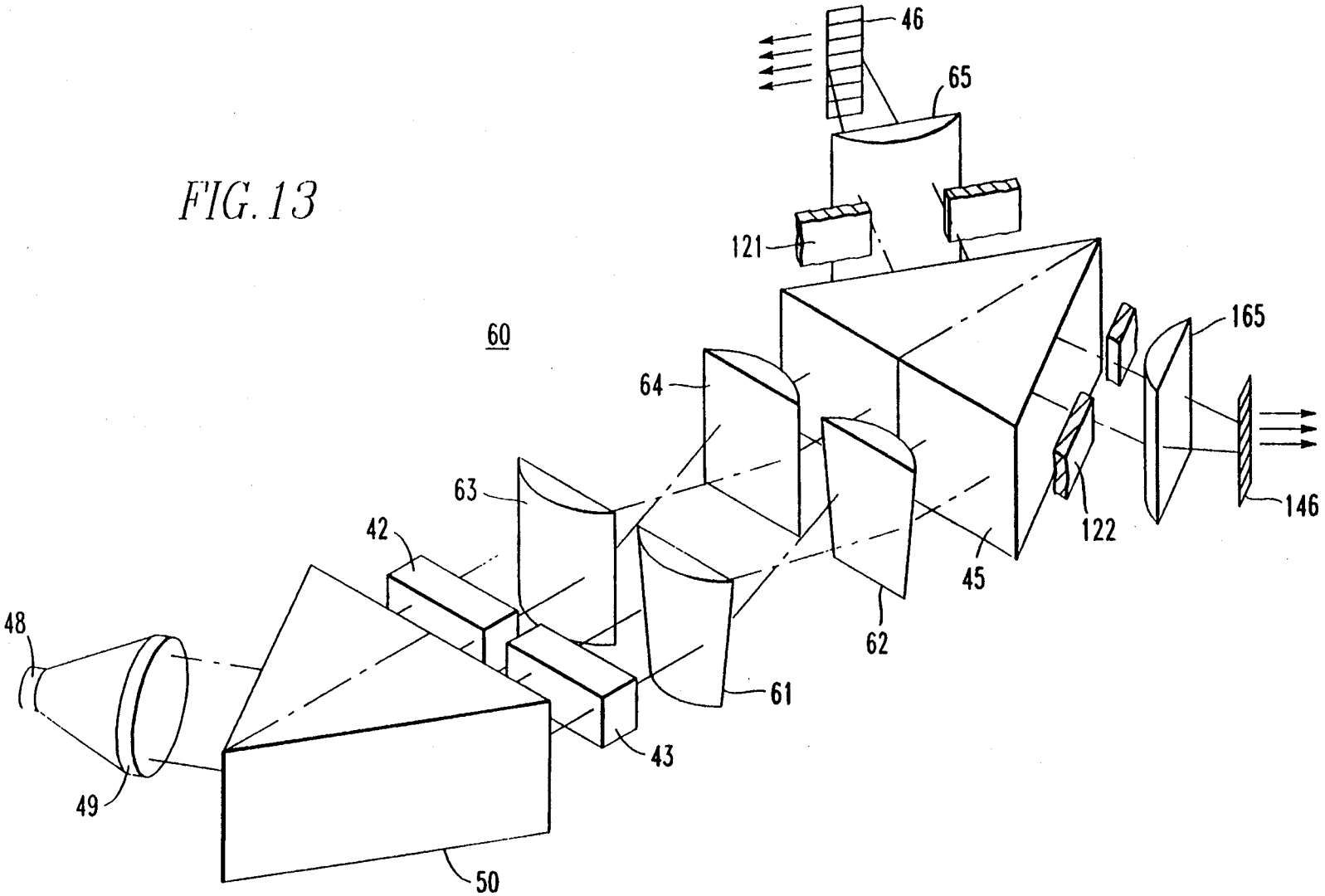
FIG. 13 is an isometric view of an optical correlator constructed in accordance with a fifth embodiment of the present invention.

FIG. 13 shows the 2-D AO correlator of the second embodiment incorporating the split aperture feature. To modify the second embodiment to include this feature, a first aperture stop 121 is placed between beam combiner 45 and cylindrical lens 65, a second aperture stop 122 is placed in the path of a second output beam from beam combiner 45, which splits the combined beam into first and second output beams, and a second cylindrical lens 165 and second photosensing means 146 are positioned to receive the second output beam propagating through second aperture stop 122.

Figure 14:
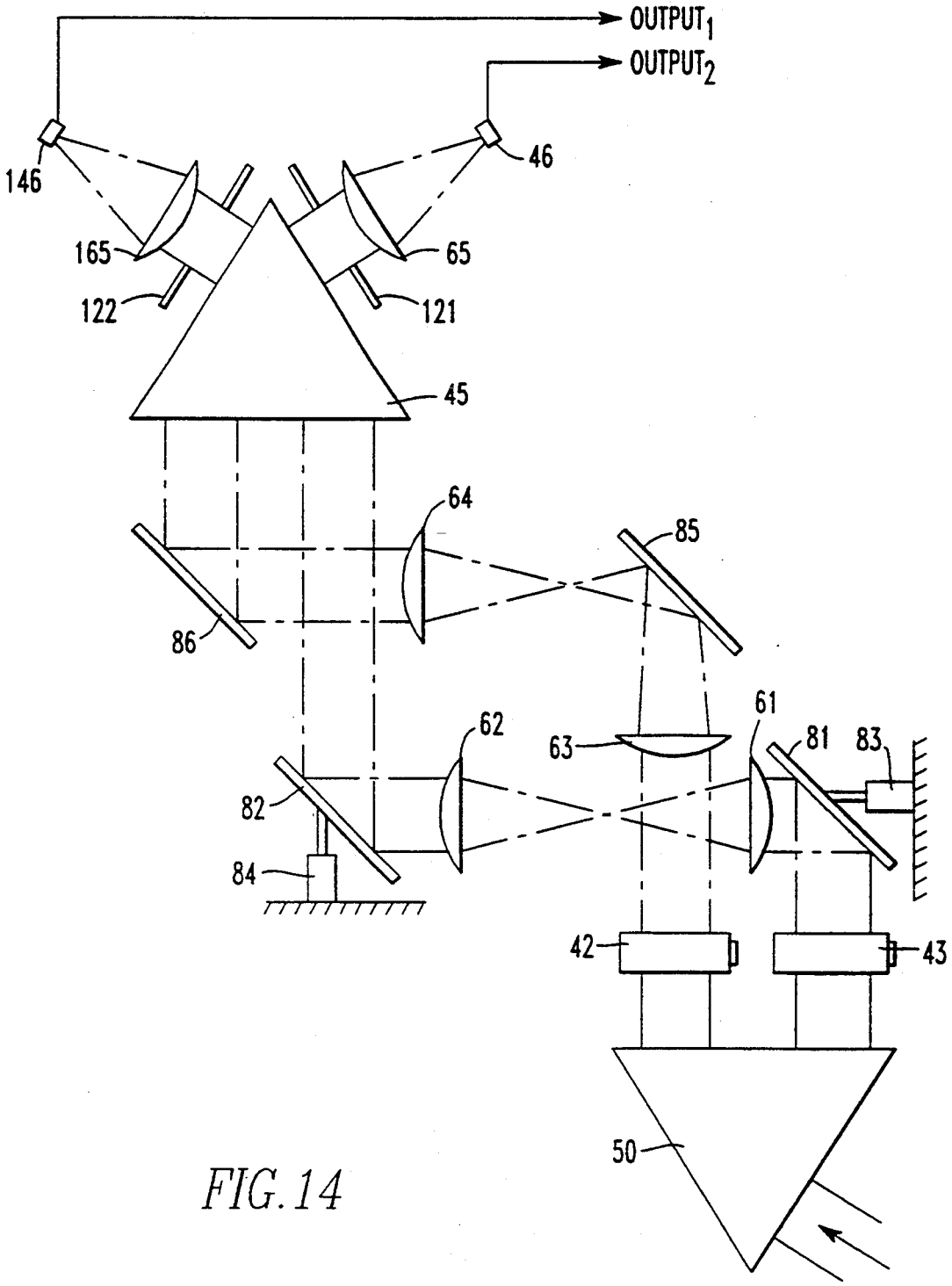
FIG. 14 is a top view of an optical correlator constructed in accordance with a sixth embodiment of the present invention.

FIG. 14 shows the sixth embodiment of the present invention which is the 2-D heterodyne AO correlator of the third embodiment incorporating the split aperture feature. The third embodiment may be modified include this feature in the same manner as the second embodiment.

By modifying the second and third embodiments, which provide the equivalent of 50 billion operations per second, to include the split aperture feature, the operating capacity may be doubled to 100 billion operations per second.

Although the split aperture feature has only been described with respect to embodiments of as being utilizable in the 2-D AO correlator and the 2-D heterodyne AO correlator, the split aperture feature can similarly be incorporated into the 3-D AO correlator of the fourth embodiment.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An apparatus comprising:

light beam generating means for generating collimated first and second light beams;

a first light modulator for modulating the first light beam with a signal;

a second light modulator for modulating the second light beam with a reference signal;

first lens means, positioned in an optical path of the second light beam, for introducing into the second light beam horizontal magnification/demagnification which gradually varies with respect to a vertical direction;

a beam combiner for combining the first and second light beams;

photodetecting means for detecting the combined light beam received from said beam combiner;

upconverting means, positioned in the optical path of the second light beam between said second light modulator and said first lens means, for introducing a first angular change in the second light beam; and down-converting means, positioned in the optical path of the second light beam between said first lens means and said beam combiner, for introducing a second angular change in the second light beam.

2. The apparatus of claim 1, further comprising:

second lens means, positioned in an optical path of the first modulated light beam between said first light modulator and said beam combiner, for horizontally focusing the first modulated light beam, wherein said first lens means horizontally focuses the second modulated light beam.

3. The apparatus of claim 2, wherein said first lens means comprises a conical lens which is tilted at an angle with respect to the vertical direction.

4. The apparatus of claim 2, wherein said second lens means comprises a cylindrical lens.

5. The apparatus of claim 1, further comprising:

second lens means, positioned in an optical path of the first modulated light beam between said first light modulator and said beam combiner, for vertically expanding and reimaging the first modulated light beam, wherein said first lens means vertically expands and reimages the second modulated light beam.

6. The apparatus of claim 5, wherein said first lens means comprises a pair of conical lenses which are tilted at an angle with respect to the vertical direction.

7. The apparatus of claim 5, wherein said second lens means comprises a pair of cylindrical lenses.

8. The apparatus of claim 1, wherein said light beam generating means comprises:

a laser diode for generating a laser beam;

a collimating lens for collimating the laser beam; and a beam splitter for splitting the collimated laser beam into the collimated first and second light beams.

9. The apparatus of claim 8, wherein said beam splitter splits the collimated laser beam such that the collimated first and second light beams propagate along parallel optical paths.

10. The apparatus of claim 1, wherein the first and second light modulating means each comprise an acousto-optic modulator.

11. The apparatus of claim 10, wherein the acousto-optic modulators of the first and second light modulating means each comprise a Bragg cell.

12. The apparatus of claim 1, wherein said photodetecting means comprises a linear array of photodetectors arranged in the vertical direction.

13. The apparatus of claim 12, wherein said photodetecting means further comprises a focusing lens for horizontally focusing the combined light beam received from said beam combiner onto said linear array of photodetectors.

14. The apparatus of claim 13, wherein said focusing lens comprises a cylindrical lens.

15. The apparatus of claim 1, wherein said photodetecting means comprises a two-dimensional array of photodetectors.

16. The apparatus of claim 15, wherein said photodetecting means further comprises a focusing lens for horizontally focusing the combined light beam received from said beam combiner onto said two-dimensional array of photodetectors.

17. The apparatus of claim 16, wherein said focusing lens comprises a cylindrical lens.

18. A method for optically correlating two signals comprising the steps of:

generating collimated first and second light beams;

providing a first modulator for modulating the first light beam with a first signal;

providing a second modulator for modulating the second light beam with a second reference signal;

introducing into the second light beam horizontal magnification/demagnification which gradually varies with respect to a vertical direction;

providing upconverting means, positioned in the optical path of the second light beam between said second light modulator and a first lens means, for introducing a first angular change in the second light beam;

providing down-converting means, positioned in the optical path of the second light beam between said first lens means and said beam combiner, for introducing a second angular change in the second light beam;

combining the first and second light beams; and detecting the combined light beam.

19. The apparatus of claim 1, wherein said up-converting means comprises a first adjustable mirror, and said down-converting means comprises a second adjustable mirror.

20. The apparatus of claim 1, wherein said beam combiner provides first and second output beams each representing the combined first and second light beams, said photodetecting means comprises a first array of photodetectors for detecting the first output beam received from said beam combiner, and a second array of photodetectors for detecting the second output beam received from said beam combiner, and wherein the first and second light modulating means each have an effective aperture width of $3\Delta t$, where $\Delta t$ is the amount of time required for a pulse of the reference signal to completely enter said second light modulating means.

21. The apparatus of claim 20, further comprising:

a first aperture having an aperture width equal to $2\Delta t$ positioned between said beam combiner and said first array of photodetectors; and a second aperture having an aperture width equal to $2\Delta t$ positioned between said beam combiner and said second array of photodetectors, wherein the first and second output beams of said beam combiner each have a width equal to 3Δt, said first aperture allows the first 2Δt of the first output beam to pass therethrough, and said second aperture allows the last 2Δt of the second output beam to pass therethrough.

22. The apparatus of claim 1, wherein said beam combiner provides first and second output beams each representing the combined first and second light beams, said photodetecting means comprises a first array of photodetectors for detecting the first output beam received from said beam combiner, and a second array of photodetectors for detecting the second output beam received from said beam combiner, and wherein the first and second light modulating means each have an effective aperture width of 3Δt, where Δt is the amount of time required for a pulse of the reference signal to completely enter said second light modulating means.

23. The apparatus of claim 22, further comprising:

a first aperture having an aperture width equal to 2Δt positioned between said beam combiner and said first array of photodetectors; and a second aperture having an aperture width equal to 2Δt positioned between said beam combiner and said second array of photodetectors, wherein the first and second output beams of said beam combiner each have a width equal to 3Δt, said first aperture allows the first 2Δt of the first output beam to pass therethrough, and said second aperture allows the last 2Δt of the second output beam to pass therethrough.

24. A SONAR correlator comprising:

light beam generating means for generating collimated first and second light beams;

a first light modulator for modulating the first light beam with a signal representative of a received sonar echo;

a second light modulator for modulating the second light beam with a reference signal representative of a transmitted sonar signal;

time compressing/expanding means, positioned in an optical path of the second light beam, for time compressing/expanding the reference signal represented by the modulated second light beam to provide a plurality of Doppler-shifted reference signals; and correlating means for correlating the signal representative of the sonar echo, which is carried by the first light beam, with each of the plurality of Doppler-shifted reference signals, which are carried by the second light beam, to provide a plurality of parallel correlation output signals.

25. The SONAR correlator of claim 24, wherein said time compressing/expanding means comprises means for introducing horizontal magnification/demagnification which gradually varies with respect to a vertical direction into the second light beam.

26. The SONAR correlator of claim 25, wherein said means for introducing horizontal magnification/demagnification comprises a pair of conical lenses which are tilted at an angle with respect to the vertical direction.

27. The SONAR correlator of claim 24, wherein said correlating means comprises:

a beam combiner for combining the first and second light beams; and photodetecting means for detecting the combined light beam received from said beam combiner.

* * * * *